US008393528B2

(12) United States Patent
Richter et al.

(10) Patent No.: US 8,393,528 B2
(45) Date of Patent: Mar. 12, 2013

(54) METHOD FOR COATING A TURBINE BLADE

(75) Inventors: Karl-Hermann Richter, Markt Indersdorf (DE); Ulrich Knott, Munich (DE); Piotr Kowalczyk, Munich (DE)

(73) Assignee: MTU Aero Engines GmbH, Munich (DE)

( * ) Notice: Subject to any disclaimer, the term of this patent is extended or adjusted under 35 U.S.C. 154(b) by 0 days.

(21) Appl. No.: 13/386,074

(22) PCT Filed: Jul. 8, 2010

(86) PCT No.: PCT/DE2010/000792

§ 371 (c)(1),
(2), (4) Date: Feb. 6, 2012

(87) PCT Pub. No.: WO2011/009430

PCT Pub. Date: Jan. 27, 2011

(65) Prior Publication Data

US 2012/0125980 A1 May 24, 2012

(30) Foreign Application Priority Data

Jul. 22, 2009 (DE) ..... 10 2009 034 168

(51) Int. Cl.
*B23K 1/00* (2006.01)
*B23K 1/19* (2006.01)

(52) U.S. Cl. ..... 228/262.9; 228/262.31; 228/262.3; 228/262.71; 228/262.72

(58) Field of Classification Search ..... 228/262.3, 228/262.31, 262.71, 262.72, 262.9
See application file for complete search history.

(56) References Cited

U.S. PATENT DOCUMENTS

| | | | | |
|---|---|---|---|---|
| 4,414,178 | A * | 11/1983 | Smith et al. | 420/444 |
| 5,198,308 | A | 3/1993 | Shetty | 428/608 |
| 5,890,274 | A | 4/1999 | Clement et al. | 29/527.2 |
| 6,164,916 | A * | 12/2000 | Frost et al. | 416/189 |
| 6,638,639 | B1 * | 10/2003 | Burke et al. | 428/583 |
| 2010/0297468 | A1 | 11/2010 | Hecht et al. | 428/615 |

FOREIGN PATENT DOCUMENTS

| | | |
|---|---|---|
| DE | 10 2007 048789 | 5/2009 |
| EP | 1 936 119 | 5/2000 |
| EP | 0 999 009 | 6/2008 |

* cited by examiner

*Primary Examiner* — Erin Saad
(74) *Attorney, Agent, or Firm* — Davidson, Davidson & Kappel, LLC

(57) ABSTRACT

A method for hardfacing a metal component surface (14, 16), especially a shroud surface of a turbine blade made of a TiAl alloy, with at least one metal material (18, 20), in particular a Co—Cr alloy. The hardfacing coating is produced separately from the component surface and is then joined to the component surface in a high-temperature soldering process. A turbine blade including such a hardfacing coating, primarily in a shroud region (2).

11 Claims, 1 Drawing Sheet

METHOD FOR COATING A TURBINE BLADE

The present invention relates to a method for providing a metallic component surface with a coating, and to a turbine blade provided with such a coating.

BACKGROUND

The blades of low-pressure turbines are frequently made of nickel-based alloys or superalloys, such as, for example, IN 713, MAR 227 and B 1900. In order to reduce abrasion, the Z-shaped contact faces of their shrouds are usually hardfaced with cobalt-chromium alloys (Co—Cr alloys or Stellites®). The height of the hardfacing is typically 2 mm in the finished state. Methods typically used for producing the hardfacing are tungsten inert gas welding, micro-plasma welding and laser-beam welding. However, if the turbine blades are made of titanium aluminide material (TiAl), they cannot be provided with a Stellite® hardfacing, because this may cause the titanium aluminide to mix with the Stellite®, as a result of which brittle phases and cracks may form in the hardfacing and the titanium aluminide base material of the shroud.

SUMMARY OF THE INVENTION

It is an object of the present invention to provide a method for providing a metallic component surface, in particular a contact face of a turbine blade made of a TiAl alloy, with a coating, which method overcomes the aforementioned disadvantages and makes it possible to achieve a hardfacing capable of withstanding stresses, and to provide a turbine blade provided with such a hardfacing.

In a method according to the present invention for providing a metallic component surface, in particular a shroud surface of a turbine blade made of a TiAl alloy, with a coating of a metallic material, in particular a Co—Cr alloy, initially, the component surface is manufactured undersized and a body is manufactured from the metallic material.

Then, the body is fixed to the component surface and joined thereto by high-temperature brazing.

The coating method of the present invention avoids material degradation and has the advantage that it allows the component surfaces to be provided with a stable coating or hardfacing without the risk of cracks forming in the hardfacing or in the base material of the component. Since the hardfacing is manufactured as a separate body, it is possible to achieve thicknesses which are cannot be achieved using alternative coating techniques, such as electroplating, PVD (Physical Vapor Deposition), or plasma spraying, so that the use of the method according to the present invention makes it possible to produce layer thicknesses greater than 2 mm.

In order to keep the effort for finishing the hardfacing low, it is advantageous for the body to already have at least two dimensions which correspond to two nominal dimensions of the hardfacing to be obtained before brazing is carried out. It is conceivable, for example, to manufacture the body such that it already has a nominal height and a nominal width of the hardfacing, so that finishing machining is performed only on lateral side surfaces defining the depth of the hardfacing.

In an exemplary embodiment, the body is indirectly joined to the component surface via an intermediate layer of a different material, in particular Inconel® 718 or nickel. The intermediate layer makes it possible to increase the bond of the body to the component because it allows the body and the component surface to be uniformly wetted by the braze material.

The intermediate layer may be in the form of a foil or plate and be applied first to the body. Then, the body is joined to the component surface via the intermediate layer.

Preferably, the intermediate layer is joined to the body at a brazing temperature which is higher than a brazing temperature for joining the intermediate layer to the component surface. The brazing temperature for applying the intermediate layer to the body may, for example, be about 1050 ° C. when a nickel-based braze material, such as a AMS 4777, is used, and the brazing temperature for joining the intermediate layer to the component surface may, for example, be equal to or less than 900 ° C. when using a nickel-based braze material with a high content of noble metal, such as gold, silver or palladium (Au, Ag, Pd). A temperature in the range of about 900 ° C. is advantageous in particular when using titanium aluminide material, because this material is inherently unable to tolerate higher brazing temperatures.

In another exemplary embodiment, the body is initially nickel-plated on its periphery and then joined to the component surface. Thus, the nickel layer acts, as it were, as an intermediate layer to improve bonding.

In a variant of the method without an intermediate layer, brazing is accomplished by induction brazing, for example, in a high-vacuum furnace or in an inert gas atmosphere. Thus, when titanium aluminide is used as the base material for the component, it is possible to set the brazing temperature to about 1050 ° C. for a short period of time without the risk of damage to the base material. This makes it possible, for example, to use AMS 4777 braze material, which allows uniform wetting of, for example, Stellite® bodies and TiAl components.

A turbine blade according to the present invention has a hardfacing applied thereto using the method of the present invention. The hardfacing is capable of withstanding stresses and can have a height or thickness of several millimeters. Through application of the method according to the present invention, which preserves the integrity of the material, damage to the turbine material or to the hardfacing itself is prevented, as is any weakening of the turbine material or of the hardfacing caused by cracks forming upon application of the hardfacing.

Other advantageous exemplary embodiments of the present invention are the subject matter of further dependent claims.

BRIEF DESCRIPTION OF THE DRAWINGS

Preferred exemplary embodiments of the present invention are described in greater detail with reference to schematic drawings, in which.

DETAILED DESCRIPTION

Figure 1:
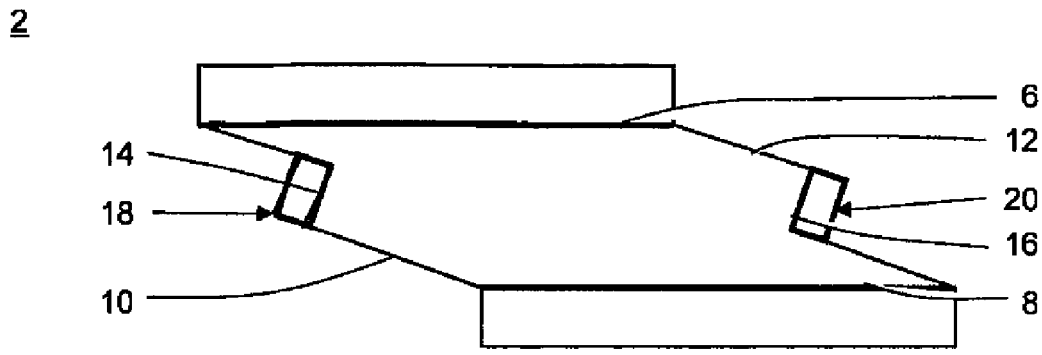
FIG. 1 is a top view of a shroud of a rotor blade of a fluid flow machine.

FIG. 1 shows a top view of a tip shroud 2 of a rotor blade of a fluid flow machine, in particular a gas turbine. Shroud 2 is made of a high-strength and high-temperature resistant titanium aluminide alloy (TiAl alloy). The shroud is substantially plate-like in shape and has two spaced-apart outer sealing lips or fins 6, 8 extending in the direction of rotation to minimize flow losses, and two Z-shaped side surfaces 10, 12. Each of Z-shaped side surfaces 10, 12 defines a lateral gap to a shroud of an adjacent rotor blade and has a flat contact face 14, 16 to provide mutual support between it and an adjacent rotor blade for vibration damping purposes. In order to reduce mechanical wear, contact faces 14, 16 are each provided with a hardfacing 18, 20.

Figure 2:
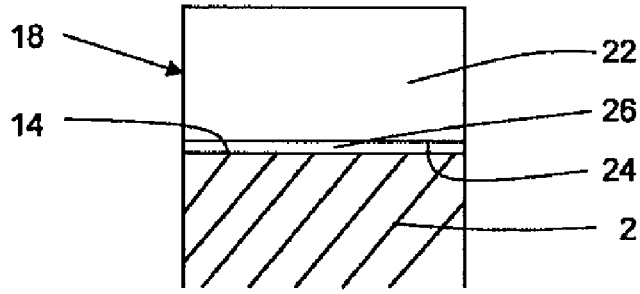
FIG. 2 is a cross-sectional view through a hardfaced region of a shroud provided with a first hardfacing according to the present invention.

Referring to FIG. 2, which shows a first exemplary embodiment of the invention, hardfacing 18, 20 has an approximately rectangular box-shaped body 22. This body or chip 22 is preferably made of a Co—Cr alloy such as, for example, Stellite® 694, is of rectangular cross section and has a flat bottom surface 24 facing contact face 14 or 16 of shroud 2.

In order to provide contact face 14 with hardfacing 18, contact face 14 is manufactured such that it is suitably undersized. Body 22 is manufactured separately from shroud 2 using, for example, casting or sintering techniques. It has a height which corresponds to a nominal height of hardfacing 18. The width of bottom surface 24 preferably corresponds to a width of contact face 14.

Upon manufacture of body 22, the body is fixed by its bottom surface 24 to contact face 14 and then brazed thereto, forming a large-area braze material layer 26 Brazing is accomplished by induction brazing, for example, in a high-vacuum furnace or in an inert gas atmosphere at a temperature of about 1050 ° C. using AMS 4777 nickel-based braze material, which is capable of uniformly wetting Stellite® contact face 24 and TiAl component surface 14.

After body 22 is brazed to shroud 2, hardfacing 18 is machined to its final dimensions. Since body 22 already has a width corresponding to contact face 14 and, in addition, the overall height of body 22 corresponds to the nominal height of hardfacing 18, machining to final dimensions (e.g. by grinding) is only required to adjust the depth of body 22 to a depth of contact face 14. Of course, body 22 may also be formed with oversized dimensions to compensate for component and assembly tolerances, in which case machining to final dimensions would also be necessary for the height and/or width of hardfacing 18. It is also obvious that body 22 may be formed in such a way that it already has all the nominal dimensions of the hardfacing, thus eliminating the need for machining to final dimensions.

Figure 3:
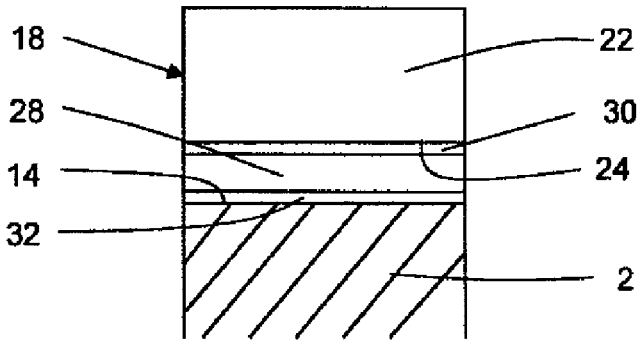
FIG. 3 is a cross-sectional view through a hardfaced region of a shroud provided with a second hardfacing according to the present invention.

Referring to FIG. 3, which shows a second exemplary embodiment of hardfacing 18, 20, body 22 may also be joined to contact face 14, 16 of shroud 2 via an intermediate layer 28. Intermediate layer 28 is disposed between contact face 14 and bottom surface 24, and serves to improve the bond of body 22 to shroud 2. The intermediate layer is preferably made of a nickel-based alloy or superalloy, such as INCONEL® 718, and is formed as a thin plate or foil of constant thickness. Bottom surface 24 of body 22 and intermediate layer 28 each have a geometry that corresponds to contact face 14, so that a maximum bonding area is created between contact face 14 and intermediate layer 28, and between intermediate layer 28 and bottom surface 24.

In order to provide contact face 14 with hardfacing 18, contact face 14 is manufactured such that it is suitably undersized. Body 22 is manufactured separately from shroud 2, and intermediate layer 28 is provided. The height of body 22 corresponds to the nominal height of hardfacing 18 minus the thickness of intermediate layer 28. The width of bottom surface 24 preferably corresponds to the width of contact face 14. Preferably, intermediate layer 28 also has a width that corresponds to the width of the contact face.

Then, intermediate layer 28 is brazed to bottom surface 24, forming a large-area braze material layer 30. This is done at about 1050 ° C. A preferred braze material is a nickel-based braze material, such as AMS 4777, because such material is capable of uniformly wetting both TiAl materials and Stellite® materials.

After intermediate layer 28 is applied to bottom surface 24, body 22 is indirectly fixed to contact face 14 via intermediate layer 28. Then, intermediate layer 28 is brazed to contact face 14, forming a large-area braze material layer 32. This is done at a temperature less than the temperature at which intermediate layer 28 is brazed to body 22. Preferably, the temperature is selected to be less than or equal to 900 ° C. A preferred braze material is nickel-based and has a high content of noble metal, such as gold, silver or palladium. Examples include Gapasil® 9, Palcusil® 10 and Palnisi® 10.

After body 22; i.e., intermediate layer 28, is brazed to shroud 2, hardfacing 18 is machined to its final dimensions. Since body 22 and intermediate layer 28 already have a width corresponding to contact face 14 and, in addition, the overall height of body 22 including intermediate layer 28 corresponds to the nominal height of hardfacing 18, machining of hardfacing 18 to final dimensions only needs to be done for one dimension, here the depth. Of course, body 22 and intermediate layer 28 may also be formed with oversized dimensions to compensate for component and assembly tolerances, in which case machining to final dimensions would also be necessary for the height and/or width of hardfacing 18.

Figure 4:
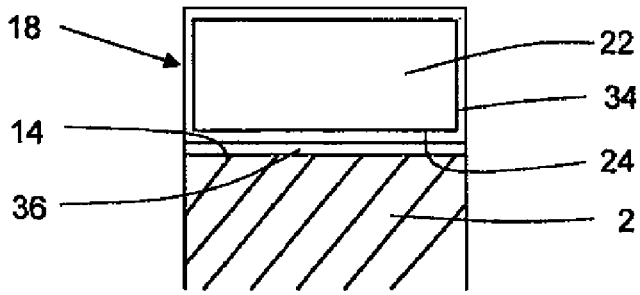
FIG. 4 is a cross-sectional view through a hardfaced region of a shroud provided with a third hardfacing according to the present invention.

In accordance with the exemplary embodiment of hardfacing 18, 20 illustrated in FIG. 4, body 22 may also be coated with a nickel layer 34 on its periphery. In this case, the nickel layer on bottom surface 24 serves, as it were, as an intermediate layer to improve bonding. The geometry of body bottom surface 24 corresponds to the geometry of contact face 14 and 16, respectively. The height of the body corresponds to the nominal height of hardfacing 18.

In order to provide contact face 14 with hardfacing 18, contact face 14 is manufactured such that it is suitably undersized. Body 22 is manufactured separately from shroud 2 and nickel-plated on its periphery. Because machining of hardfacing 18 to its nominal dimensions is no longer possible once the nickel layer is applied, body 22 already has the nominal dimensions of hardfacing 18 before its is nickel-plated. This means that prior to the application of the nickel layer, body 22 has a height corresponding to the nominal height of hardfacing 18; and the width and depth of its bottom surface 24 correspond to the width and depth of contact face 14. After body 22 is nickel-plated, it is fixed by its nickel-plated bottom surface 24 to contact face 14 and then brazed thereto by a braze material layer 36 at a temperature of about 900 ° C.

Disclosed is a method for hardfacing a metallic component surface, in particular a shroud surface of a turbine blade made of a TiAl alloy, with at least one metallic material, in particular a Co—Cr alloy, in which method the hardfacing is produced separately from the component surface and subsequently joined thereto using a high-temperature brazing technique. Also disclosed is a turbine blade which is provided with such a hardfacing, especially in a shroud region.

What is claimed is:

1. A method for providing a TiAl-component surface with a coating of at least one metallic material comprising the steps of:

manufacturing the component surface with undersized dimensions;

coating the component with the at least one metallic material, the step of coating including manufacturing a body composed of the at least one metallic material;

fixing the body to the component surface; and joining the body to the component surface by brazing;

wherein an intermediate layer of a different material is first applied to the body, and then the intermediate layer is joined to the component surface by the brazing, a brazing temperature for joining the intermediate layer to the component surface being less than or equal to 900° C.; and wherein the brazing includes joining the intermediate layer to the body at a first brazing temperature higher than the brazing temperature for joining the intermediate layer to the component surface.

2. The method as recited in claim 1 wherein prior to the joining, the body has at least two dimensions corresponding to two nominal dimensions of the coating.

3. The method as recited in claim 2 wherein subsequent to the brazing, the body is machined to final dimensions with respect to width and/or depth.

4. The method as recited in claim 1 wherein the brazing temperature for applying the intermediate layer to the body is about 1050° C.

5. The method as recited in claim 4 wherein the brazing includes using nickel-based braze materials with a high content of noble metal.

6. The method as recited in claim 5 wherein the noble metals include gold, silver or palladium.

7. The method as recited in claim 1 wherein the different material includes nickel, and wherein intermediate layer is applied to the body by nickel-plating the body on a periphery prior to joining the body to the component surface.

8. The method as recited in claim 1 wherein the at least one metallic material includes a Co—Cr alloy.

9. The method as recited in claim 8 wherein the different material includes Inconel® 718 or nickel.

10. The method as recited in claim 1 wherein the different material includes Inconel® 718 or nickel.

11. A method for providing a TiAl-shroud surface of a turbine blade with a coating of at least one metallic material comprising the steps of:

manufacturing the shroud surface with undersized dimensions;

coating the shroud surface with the at least one metallic material, the step of coating including manufacturing a body composed of the metallic material;

fixing the body to the shroud surface; and joining the body to the shroud surface by brazing;

wherein an intermediate layer of a different material is first applied to the body, and then the intermediate layer is joined to the shroud surface by the brazing, a brazing temperature for joining the intermediate layer to the shroud surface being less than or equal to 900° C.; and wherein the brazing includes joining the intermediate layer to the body at a first brazing temperature higher than the brazing temperature for joining the intermediate layer to the shroud surface.

* * * * *